US006010156A

United States Patent [19]

Block

[11] Patent Number: 6,010,156

[45] Date of Patent: Jan. 4, 2000

[54] COMBINED ADDRESS AND POSTAGE LABEL AND SYSTEM FOR PRODUCING THE SAME

[75] Inventor: David L. Block, El Cerrito, Calif.

[73] Assignee: Costar Corporation, Greenwich, Conn.

[21] Appl. No.: 08/935,453

[22] Filed: Sep. 24, 1997

[51] Int. Cl.[7] ..... B42D 1/00

[52] U.S. Cl. ..... 281/2; 281/5; 283/81; 283/101; 428/40; 428/42

[58] Field of Search ..... 283/81, 101; 281/2, 281/5; 428/40, 42

[56] References Cited

U.S. PATENT DOCUMENTS

| | | | |
|---|---|---|---|
| 4,934,846 | 6/1990 | Gilham | 400/104 |
| 4,938,414 | 7/1990 | Lippert . | |
| 5,129,682 | 7/1992 | Ashby | 283/81 |
| 5,190,210 | 3/1993 | Walz | 229/69 |
| 5,200,903 | 4/1993 | Gilham | 364/464.18 |
| 5,292,008 | 3/1994 | Sansone et al. | 209/584 |
| 5,325,303 | 6/1994 | Walz et al. | 705/404 |
| 5,388,049 | 2/1995 | Sansone et al. | 705/406 |
| 5,407,718 | 4/1995 | Popat et al. | 428/41.5 |
| 5,501,393 | 3/1996 | Walz | 229/92.8 |
| 5,547,227 | 8/1996 | Laurash et al. | 283/81 |
| 5,573,277 | 11/1996 | Petkovsek | 283/79 |
| 5,836,622 | 11/1998 | Fabel | 283/62 |

OTHER PUBLICATIONS

Pitney Bowes Model 5630 Operating Guide.

CoStar User Manual for Addressmate and AddressMate Plus.

CoStar User Manual for Labelwriter XL Printer.

Information Based Indicia Program Host System Specificatio, United States Postal Service (Oct. 9, 1996 Draft).

Commercially available label from www.paperdirect.com.

*Primary Examiner*—Andrea L. Pitts
*Assistant Examiner*—Monica Smith
*Attorney, Agent, or Firm*—Baker & Botts, L.L.P.

[57] ABSTRACT

A mailing label and system and method for preparing the same is provided. The mailing labels are provided on a continuous perforated strip, where the perforations define unitary fields of labels, including at least a label for an intended recipient's address and a label for bearing a postal service approved postage indicia, to be used on a single item to be mailed. The strip is adapted for use with a computer driven printer capable of printing the recipient's address, the postage indicia and other data relating to the item to be mailed on the labels within a given unitary field. The system and method according to the invention provide for the ability to prepare the aforementioned mailing labels by effectively combining the functions of a postage meter with a system for preparing mailing labels. Address information, weight and postal class information, and any other information to be associated with the item to be mailed are provided to a computer system which formats the information pursuant to postal service requirements, and prints the address data, postage indicia and other information regarding the item to be mailed on the appropriate labels within a unitary field on a strip of labels according to the invention.

4 Claims, 3 Drawing Sheets

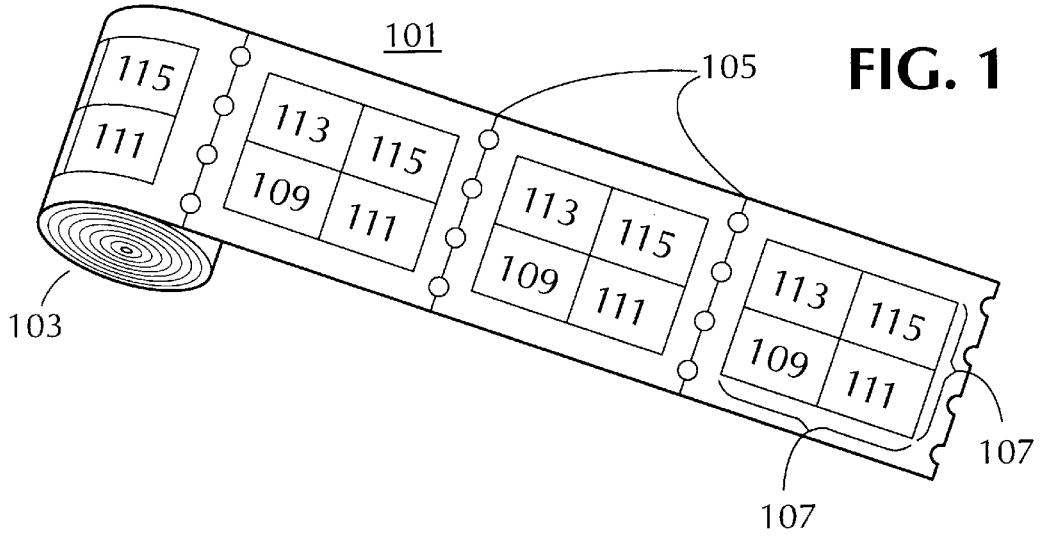
FIG. 1
FIG. 2
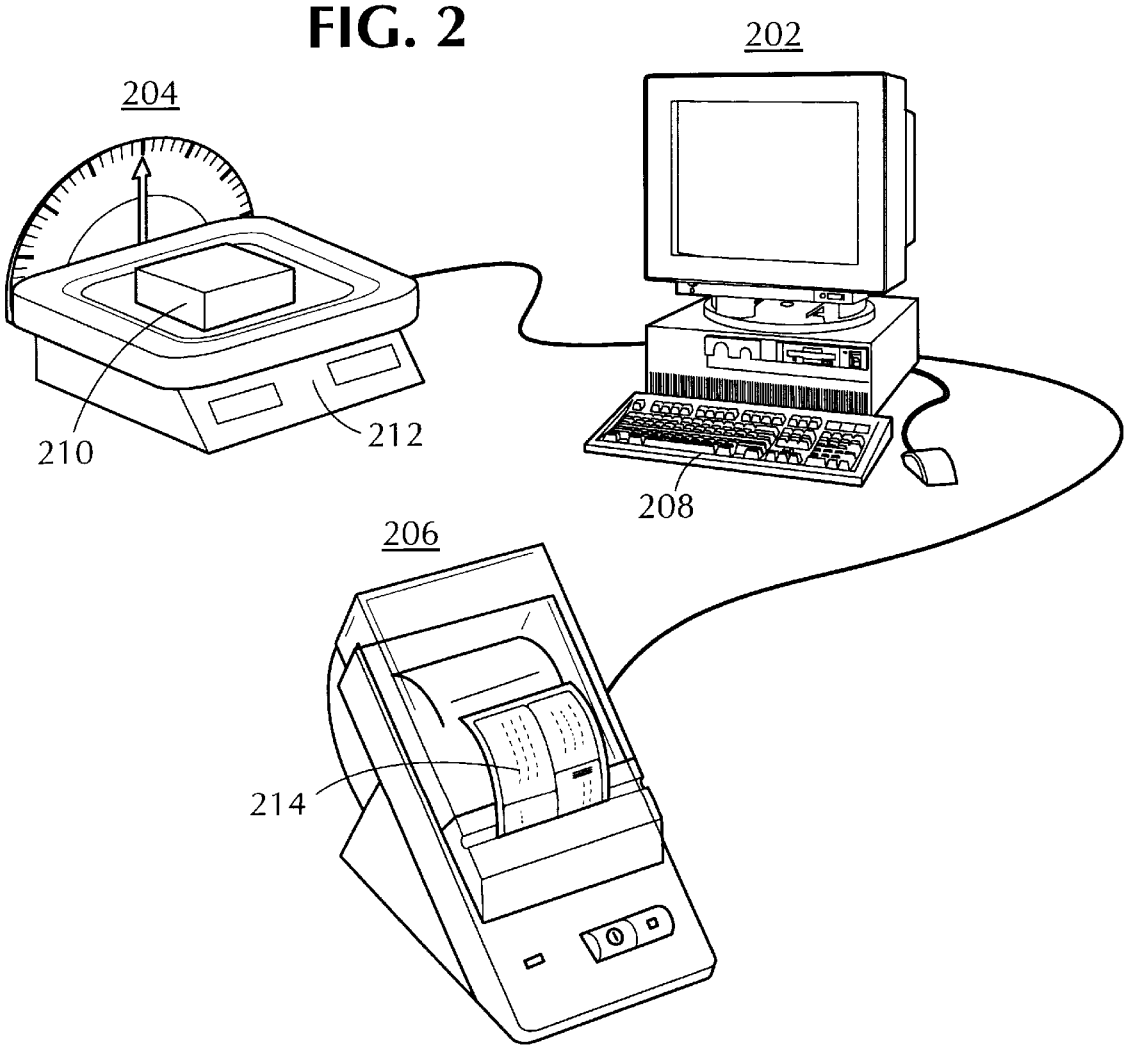

COMBINED ADDRESS AND POSTAGE LABEL AND SYSTEM FOR PRODUCING THE SAME

BACKGROUND OF THE INVENTION

United States Postal Service (USPS) approved postage meters for use by businesses and individuals have long been a staple in United States commerce. Typical postage meters commercially available from companies such as Pitney Bowes of Stamford, Connecticut, are capable of weighing a particular item to be mailed and printing a USPS approved postal indicia in the dollar amount required based on the postal service class (parcel post, first class, etc.) desired. A popular example of a conventional postage meter is the Pitney Bowes Model 5630, whose function and modes of operation are fully described in its Operating Guide, which is incorporated herein by reference. The postal indicia, used in lieu of a stamp, have conventionally been printed on a self-adhesive strip or directly on a letter to be mailed. Conventional postage meters include a postal security device that maintains an accounting of available postage, purchased from the USPS or other third parties, within the meter. The available postage can be replenished mechanically or electronically in various increments through the USPS or other approved third parties as required by the user.

With the advent of the personal computer and accessories available for use therewith, business and individuals conveniently prepare correspondence, which include mailing address information, through a variety of commercially available word processing software packages and computer printers that function therewith. One convenient accessory available for use with word processing systems involves the automated preparation of mailing address labels. Such label preparation systems, for example the CoStar Labelwriter XL printer and CoStar AddressMate software available from the CoStar Corporation of Greenwich, Connecticut, are capable of identifying address data from a computer data file representing an intended correspondence, formatted, for example, by various popular word processing packages such as Corel WordPerfect and Microsoft Word. The CoStar label preparation system can format and print mailing address labels based on the data contained in a data file representing an intended correspondence, or, alternatively, address information for preparation of mailing labels can be directly input into a computer system independent of a data file representing an intended correspondence. The function and modes of operation of the exemplary CoStar printer and software are detailed in the CoStar User Manual for AddressMate and AddressMate Plus and User Manual for Labelwriter XL printer, incorporated herein by reference.

While the above-mentioned postage meters and label printing systems are known, it has not been previously known to produce computer generated labels grouped to provide associated address and postal indicia for a single piece of mail. That is, it has not been known to combine the advantages of a postage meter with the advantages afforded by known mailing label generation systems. The USPS in October 1996 published a draft specification of Information Based Indicia Program Host Systems which establishes guidelines for preparation of such combined address and postage labels.

It is, accordingly, an object of the present invention to provide computer generated labels grouped such that address information and an associate postal indicia can be printed in a unitary manner for use on an item to be mailed, in compliance with USPS specifications. It is a farther object of this invention to provide a system and method for generating mailing labels having associated address information and postal indicia for an item to be mailed grouped in a unitary manner, in compliance with USPS specifications. Further objects and improvements associated with the present invention will be apparent to those skilled in the art upon review of the description of the preferred embodiments detailed below.

SUMMARY OF THE INVENTION

The present invention overcomes the shortcomings of the prior art by providing a computer generated mailing label constructed from a perforated strip of segmented self-adhesive labels which can be continuously fed through a computer printer. The perforations define and functionally separate fields of labels associated with a specific item to be mailed. Each field would include at least a label for the recipient's address and a label for a postal service approved indicia, to be applied to the item to be mailed. Additional labels, such as return address or postal handling instruction labels, could also be included within each field of labels. The present invention also discloses a system and method for preparing computer generated mailing labels, where a computerized system is provided with address and required postage information, and potentially other information such as return address or handling instructions, relating to an item to be mailed. The computer and an associated printer then print an address and postage indicia, and any other information, on the appropriate labels within a field on a perforated strip of segmented self-adhesive labels of the type disclosed in this invention. The computerized method of preparing such mailing labels further includes an accounting step to ensure proper accounting of funds allocated by the USPS for use in the computer system which prepares the labels. Accordingly, the functions of a postage meter and address label printing are effectively combined in a single unified system.

BRIEF DESCRIPTION OF THE DRAWINGS

Exemplary embodiments in accordance with the present invention will now be described with reference to the accompanying drawings, in which:

FIG. 1 is a continuous strip of multiple fields of address and postage labels according to the invention;

FIG. 2 is a prospective rendering of the equipment comprising the system used in preparing labels according to the invention;

DESCRIPTION OF PREFERRED EMBODIMENTS

Figure 3A:
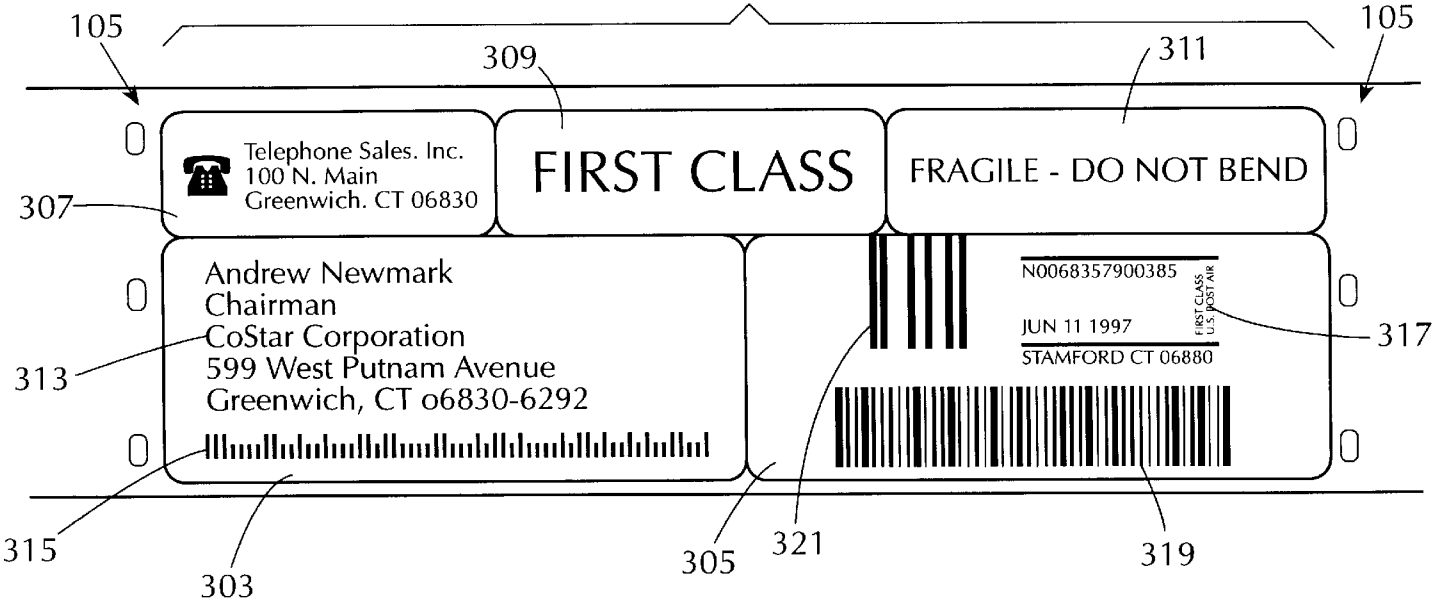
FIG. 3A is a single field of mailing and postage labels for an item to be mailed according to the invention.

Referring now to FIG. 1, there is shown a perforated strip of self-adhesive labels (101) in accordance with the present invention. The strip (101) is shown to be a continuous roll (103) divided into equally spaced sections by perforations (105). The perforations (105) define individual fields of labels (107). The perforations need not be holes or serrations, but can be any suitable means of functionally separating the individual fields of labels, including, for example, dark lines which can be optically recognized by a human user or an electronic printer used in conjunction with the continuous strip of labels. Each field of labels (107) contains multiple labels to be associated with a single item of mail (not shown). The strip can take any form where fields of labels can be consecutively attached and continuously fed through a printer. For example, a roll of labels can be mounted on a spindle within a printer as in the CoStar Labelwriter XL printer or on consecutive sheets to be fed through a conventional dot matrix printer or thermal printer.

In the embodiment shown in FIG. 1, each field has four segmented self-adhesive labels (109, 111, 113, 115) to be associated with an item to be mailed. A minimum of two label segments are required in each field in accordance with this invention to accommodate the intended recipient's address and a postal service approved postage indicia for mailing purposes, the postage indicia to replace stamps bearing the required postal fee. Additional labels within each field to be associated with a single item to be mailed may be added to accommodate a user's need. Each label within the field may also be customized and sized to accommodate the desired use, and various strips with variously formatted layouts may be made commercially available. The intended use for each label within a field may dictate its size requirement, with larger packages having larger labels, or labels requiring more text being sized larger.

In the embodiment shown in FIG. 1, for example, labels 109 and 111 are shown to be larger than labels 113 and 115. Labels 109 and 111 are sized to contain the intended recipient's address data and return address data respectively. Smaller labels 113 and 115 are meant to contain the postal service postage indicia and postal handling instructions (i.e., Fragile, Handle With Care, etc.). Of course, the present invention envisions the number of labels, size of each label and intended use of each label within each field to be varied to maximize the convenience and utility to the end user. It is expected that once the address information, postal indicia and any other informational labels to be printed on labels within a field are printed, the user will separate a field along the perforations. The resultant group of labels within the field will thus comprise a unitary group of labels which may be separated and affixed to a single item to be mailed. Such unitary structure will minimize confusion and mistake with respect to misassociating address and postal indicia to be affixed to items to be mailed.

FIG. 2 is a block diagram illustrating a preferred embodiment of the finctional elements of the system employed to practice the method of preparing mailing labels, including associated address information and postage indicia, in accordance with the present invention. The principal elements include a computer (202) interfaced to a postal scale/meter (204) and a printer (206) capable of printing address information and postage indicium on perforated continuous strip of fields of labels of the type disclosed above.

The computer (202) is capable of receiving an intended recipient's address information by any one of a number of conventional ways. For example, the computer employing commercially available software, such as the CoStar products discussed above, can discern a recipient's address from an electronic data file resident on the computer, where this data file is created by commercially available word processors such as WordPerfect or Microsoft Word. The data file can represent the intended correspondence or may merely be included with the item to be mailed. Alternatively, an intended recipient's address information could be prompted and directly input into the computer through a user interface such as a standard alphanumeric keyboard (208) or scanner (not shown). In similar manners the computer (202) is capable of receiving return address information regarding the sender, for example, from an electronic data file or through a user interface. The user interface (208) can additionally be used to input postal class, handling instructions and weight data relating to an item to be mailed.

The computer (202) is further capable of receiving weight, postal class and handling instructions regarding an item to be mailed through, for example, a postal scale/meter (204). A package (210) to be mailed would be placed on the scale (204) and the package's weight could be electronically transferred to the computer. The postal scale/meter can also be provided with a user interface such as a keyboard or key pad (212) where postal class information and/or handling instructions could be input and transferred to the computer (202). It would also be possible to input the recipient and return address information via the postal scale/meter user interface (212) to be received therethrough by the computer (202).

The system is further capable of determining the required postage for an item to be mailed. In a conventional manner weight and class information can be translated into a postage amount necessary for the item to be mailed. The rate will be determined based on postal rates established by the USPS at the time of mailing. These rates may be determined by a variety of conventional means for receipt by the computer, including updated rate schedules resident in the computer or postal scale/meter, or through manual look up tables for input by a user through a user interface.

The system will also include a postal security device resident in the computer (202) or the postal scale/meter (204) that will provide a secure accounting function regarding funds available to print postal indicia. The accounting process will ensure a sufficient account balance exists for the user to cover the postage required for an item to be mailed and maintain account balance data for the user. Such postal security devices are well known in the art and have long been used with conventional postage meters. Funds may be replenished, for example, electronically through user accounts maintained with the USPS or other approved third party vendors.

The system also includes a printer (206) interfaced with the computer (202). The printer is capable of feeding and printing on the continuous perforated strips (214) delineating fields of labels associated with individual items to be mailed. The printer is capable of receiving from the computer and printing on the appropriate label within each field of labels the recipient address and a USPS approved postage indicia of the proper postage amount for the item to be mailed, as well as other data associated with the item to be mailed, such as return address, postal class and handling instruction information. The printer may be a dedicated label printer such as the CoStar Labelwriter XL or may be any other type of printer capable of receiving and printing on continuous perforated sheets, including conventional dot matrix and thermal printers.

FIG. 3A displays an exemplary embodiment of a single field (301) of labels for an item to be mailed prepared in accordance with the present invention. The field of labels is a unitary segment containing data relating to the item to be mailed which is separated from contiguous fields by perforations (105). The labels within this exemplary field include a recipient address label (303), a postage indica label (305), a return address label (307), a postal class label (309) and a handling instruction label (311). Each label, except the recipient address and postage indicia labels, is an optional element of the present invention and may be utilized as deemed appropriate by the user. It is anticipated that additional labels bearing other information whether or not relating to the item to be mailed can be added as desired by the user.

As shown in FIG. 3A, the recipient address label contains a standardized postal address (313) received from the computer and a USPS standard delivery point bar code (315) which may be conventionally generated by the computer. The postal indicia label (305) contains three parts as may be required by the USPS: a human readable postage part (317), a standard two-dimensional bar code (319) containing USPS readable data relating to the host system which produced the label, and a USPS standard facing identification mark (321), which may alternatively be preprinted on envelopes. The return address label (307) is shown to contain an optional company logo. The postal class label (309) may contain any USPS service options such as First Class, Parcel Post, and the like. The handling instruction label may contain user desired notes such as "Fragile," "Do Not Bend," and the like.

Figure 3B:
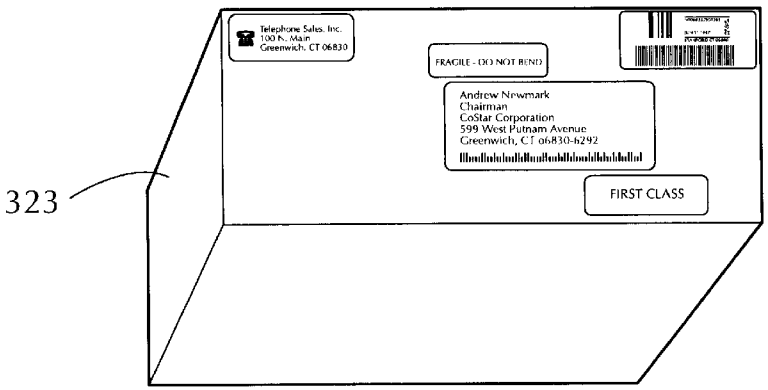
FIG. 3B shows the mailing and postage labels applied to a package according to the invention.

As shown in FIG. 3B, following printing of the integrated field of labels for the item to be mailed, the labels are separated and applied to the item to be mailed, shown here as a package (323). Because the labels for each item to be mailed are printed in an integrated field, mistakes whereby indicia, addresses and other information relating to the item to be mailed become disassociated from each other will be reduced. This integration feature will reduce mistakes, particularly where multiple mailing labels for multiple items to be mailed are printed consecutively.

Figure 4:
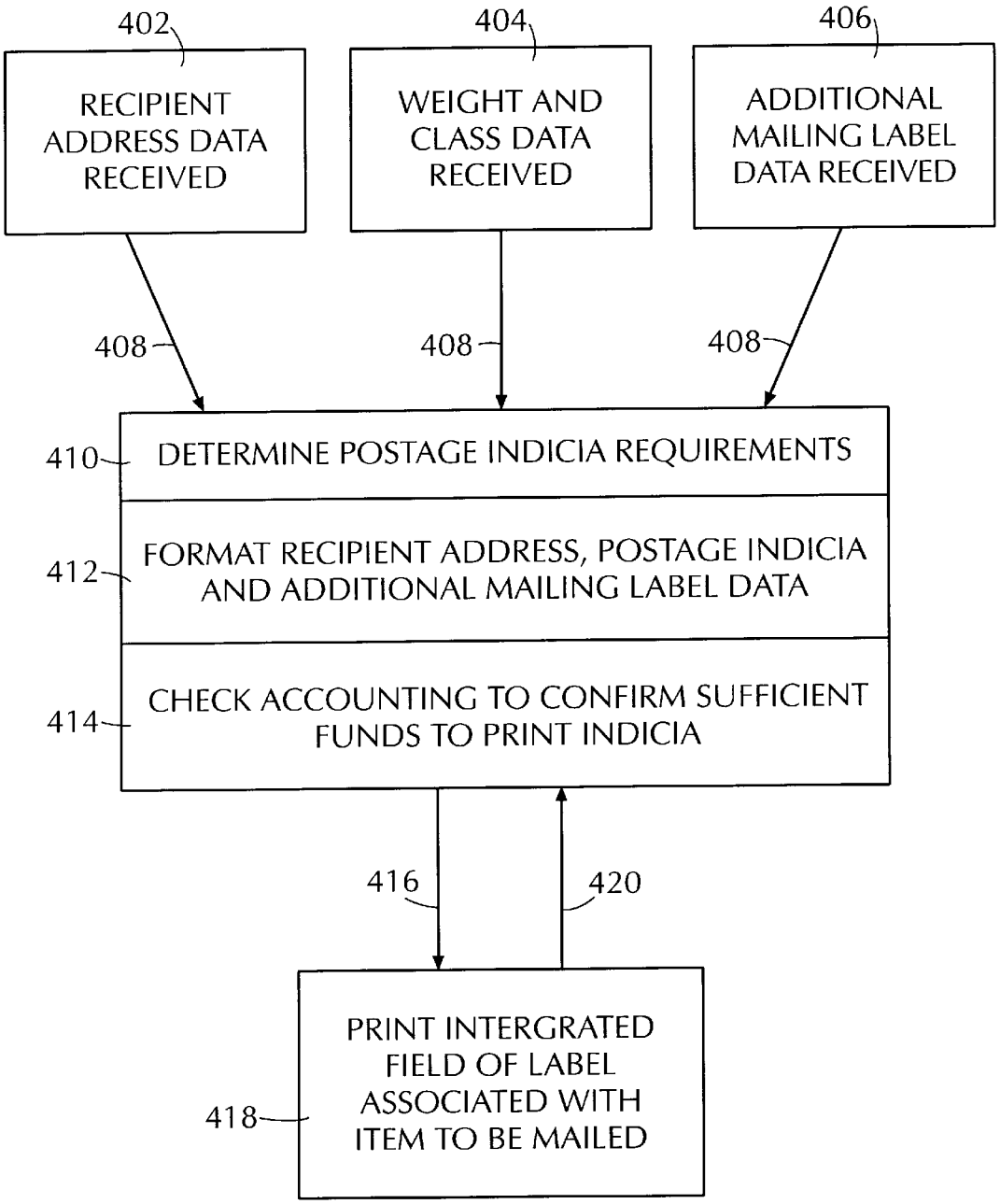
FIG. 4 is a functional diagram of the steps used in the methodology of preparing mailing and postage labels according to the invention.

FIG. 4 shows a basic flow chart of the steps associated with one possible method of printing mailing labels employing one version of the preferred embodiment of the above-described system for preparing mailing labels in accordance with the present invention. Recipient address data (402), weight and class data (404) and any additional mailing label data (e.g., return address, postal class or handling data (406)) associated with the item to be mailed are provided (408) to a computer for processing. These data can be provided from direct user input, an electronic data file, a postal scale/meter or other suitable source. The computer will: (a) determine the postage indicia requirements (410) based on the weight, class and address data; (b) format the recipient address, postage indicia and additional mailing label data (412) for printing in accordance with USPS requirements and the label format of the perforated strip of fields of labels being used; and (c) check the postal security device accounting to confirm sufficient finds remain to print the required indicia (414). The formatted data is then sent to a printer (416) capable of processing to a continuous perforated strip of integrated labels. The printer will then print the integrated field of mailing labels associated with the item to be mailed. Finally, the accounting means is updated (420) within the computer such that labels relating to the next item to be mailed can be processed.

While the invention has been described in terms of the foregoing specific embodiments thereof, it will be apparent to those skilled in the art that various alterations and modifications may be made to the described embodiments without departing from the scope of the invention, as defined by the appended claims. The mailing labels, system and methodology detailed in the disclosure have been provided merely by way of example.

We claim:

1. A computer generated mailing label comprising:

a perforated strip of segmented self-adhesive labels, said perforations defining a plurality of fields wherein each field comprises a separate address label and a separate postage label to be affixed to an item to be mailed, the strip being adapted for use with a computer driven printer wherein the printer is adapted to print an intended recipient's address on the address label and a postal service approved postage indicia on the postage label in a preselected one of said fields.

2. The computer generated mailing label of claim 1 wherein each field of labels further comprises a return address label on which a return address of a sender is printed by the computer driven printer.

3. The computer generated mailing label of claim 1 wherein each field of labels further comprises a handling direction label on which handling directions for the item to be mailed is printed by the computer driven printer.

4. The computer generated mailing label of claim 1 wherein a postal class label on which the desired postal class for the item to be mailed is printed by the computer driven printer.

* * * * *

UNITED STATES PATENT AND TRADEMARK OFFICE

CERTIFICATE OF CORRECTION

PATENT NO. : 6,010,156
DATED : January 4, 2000
INVENTOR(S) : David L. Block

It is certified that error appears in the above-identified patent and that said Letters Patent is hereby corrected as shown below:

On the title page, item [56]

References Cited, U.S. PATENT DOCUMENTS, the following patents should also be included:

-- 5,626,286 5/1997 Petkovsek
5,626,370 5/1997 Petkovsek
5,640,447 6/1997 Fonseca
5,664,725 9/1997 Walz
5,697,648 12/1997 Petkovsek
5,721,813 2/1998 Leinhos
5,746,450 5/1998 Petkovsek
5,801,944 9/1998 Kara --

References Cited, OTHER PUBLICATIONS, "Addressmate" should read --AddressMate--.
References Cited, OTHER PUBLICATIONS, "Specificatio" should read --Specification--.
Column 1, line 67, "farther" should read --further--.
Column 3, line 46, "finctional" should read --functional--.

Signed and Sealed this

Twenty-first Day of November, 2000

*Attest:*

Q. TODD DICKINSON

*Attesting Officer*

*Director of Patents and Trademarks*